United States Patent [19]

Haney

[11] Patent Number: 4,492,501

[45] Date of Patent: Jan. 8, 1985

[54] PLATFORM POSITIONING SYSTEM

[75] Inventor: Keith M. Haney, Wichita Falls, Tex.

[73] Assignee: Walker-Neer Manufacturing Company Inc., Wichita Falls, Tex.

[21] Appl. No.: 483,560

[22] Filed: Apr. 11, 1983

[51] Int. Cl.[3] ..... E04H 12/18; E21B 15/00

[52] U.S. Cl. ..... 414/22; 52/119; 182/131

[58] Field of Search ..... 414/22; 175/85; 52/116, 52/117, 118, 119, 120; 182/2, 131; 212/255, 258

[56] References Cited

U.S. PATENT DOCUMENTS 3,202,241 8/1965 Woolslayer et al. ..... 182/131 X 4,221,088 9/1980 Patterson ..... 52/116

*Primary Examiner*—Robert J. Spar

*Assistant Examiner*—Janice Krizek

*Attorney, Agent, or Firm*—Willian, Brinks, Olds, Hofer, Gilson & Lione Ltd.

[57] ABSTRACT

A platform positioning system for a drilling device of the type which includes a support structure and a transfer arm pivotally connected to the support structure to rotate about a first axis is disclosed. This platform positioning system includes a platform which is pivotally connected to the support structure to rotate about a second axis, and a rod which is mounted between the transfer arm and the platform. The position of the arm and platform axes and the length of the rod are selected such that the transfer arm automatically and progressively raises the platform to the raised position by means of the rod as the transfer arm moves to the raised position, and the transfer arm automatically and progressively lowers the platform to the lowered position by means of the rod as the transfer arm moves to the lowered position.

10 Claims, 10 Drawing Figures

FIG. 2
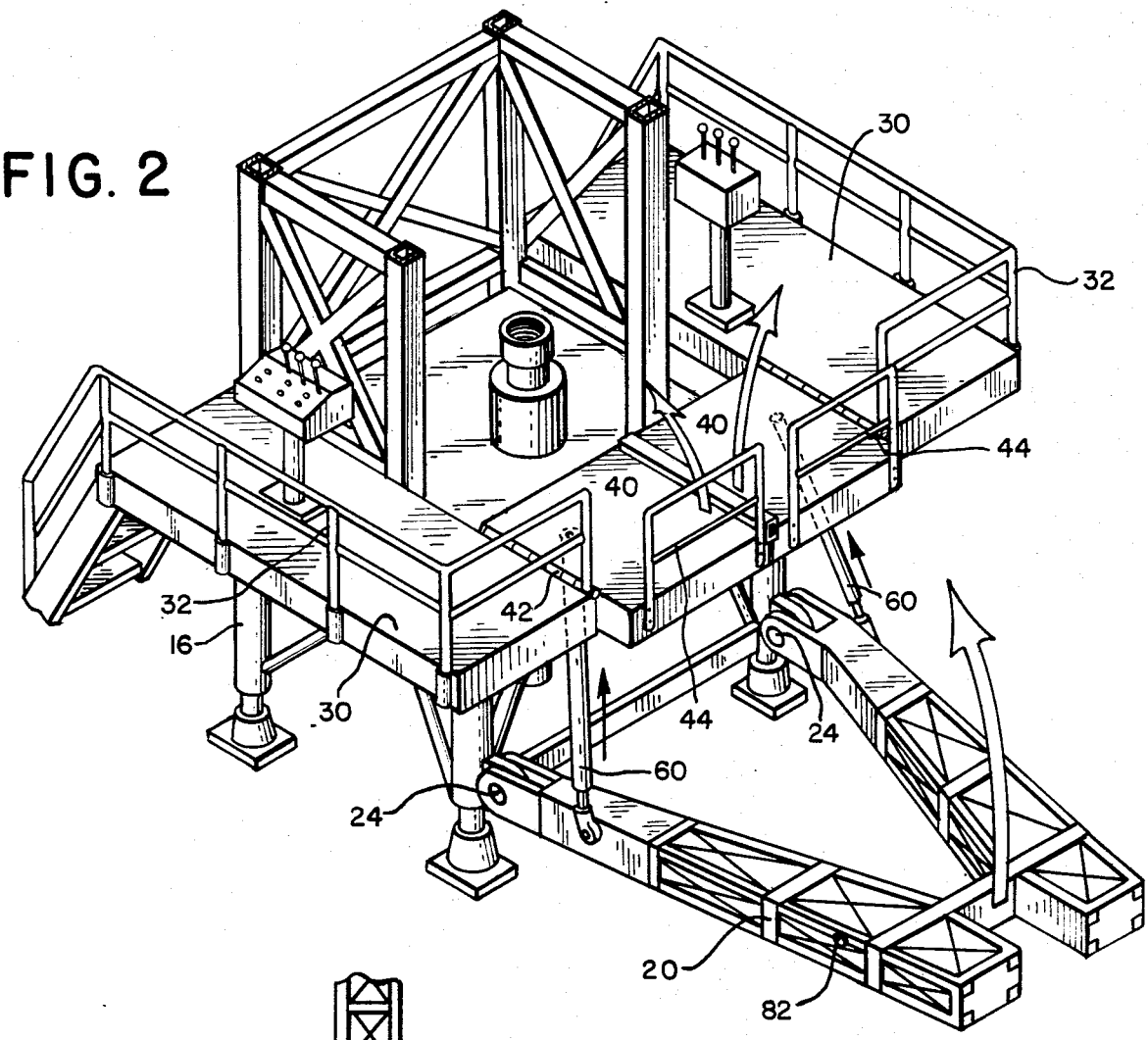
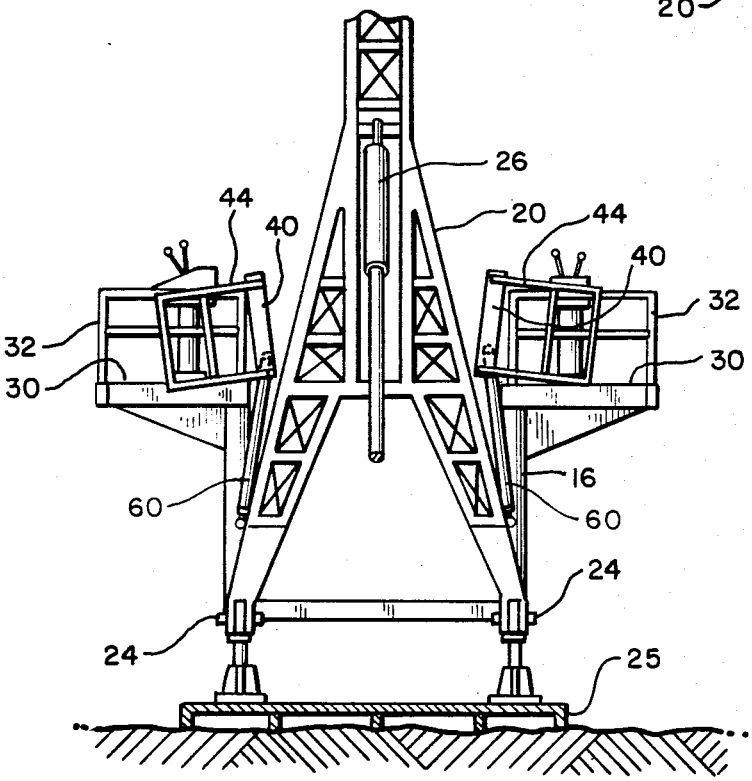
FIG. 3

FIG. 7
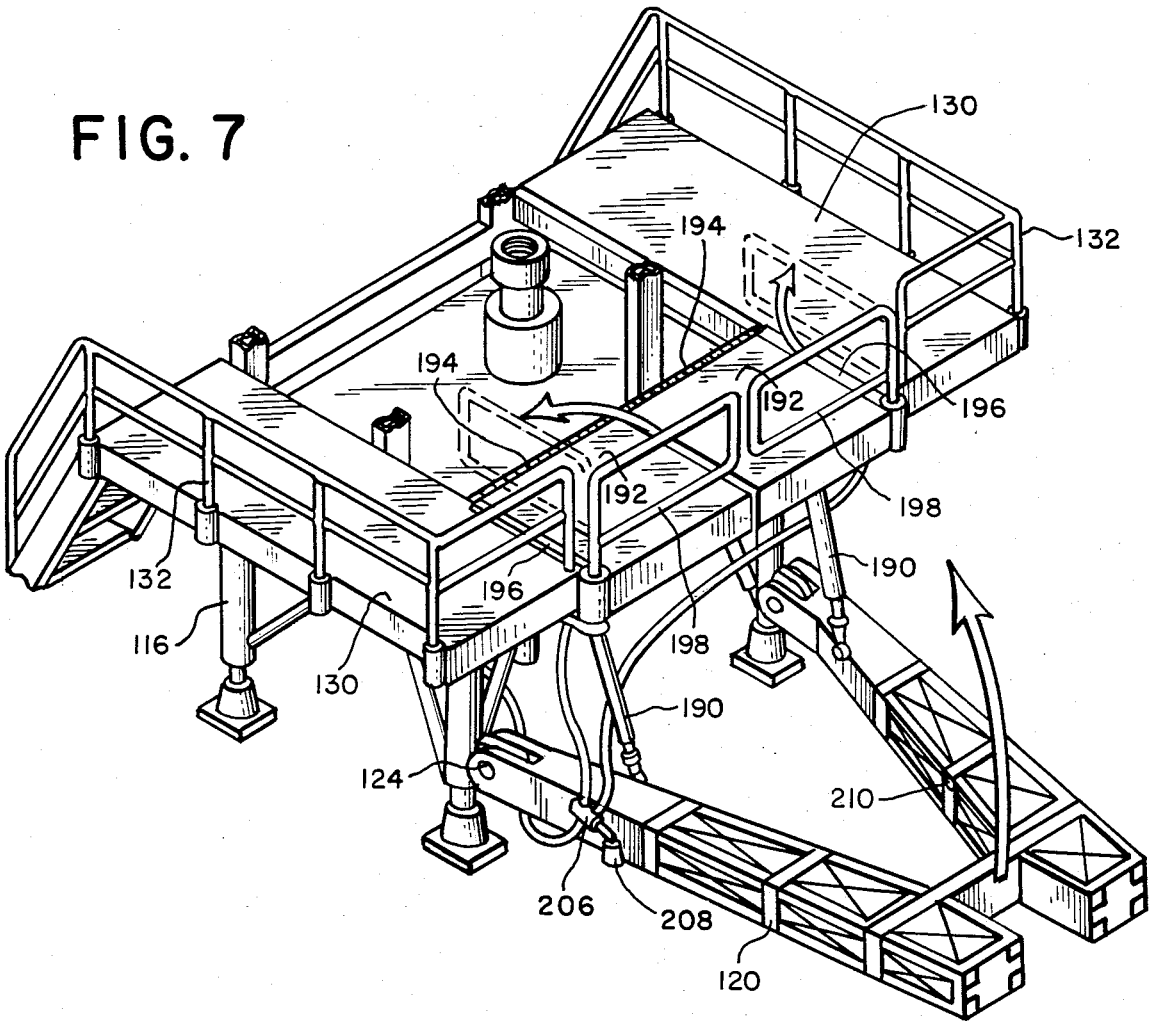
FIG. 8
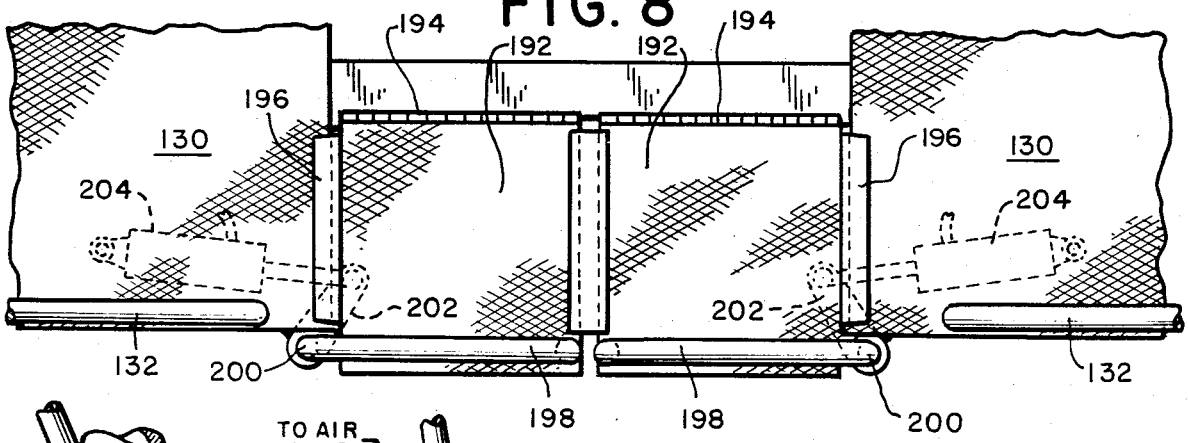
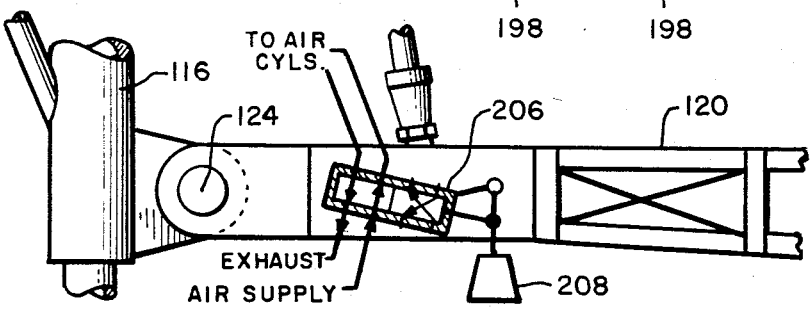
FIG. 9

PLATFORM POSITIONING SYSTEM

BACKGROUND OF THE INVENTION

The present invention relates to an improved system for automatically positioning a platform-type work station on a drilling device, such as a drill rig.

One class of prior art drilling devices employs a transfer arm which is pivoted about a horizontal axis to raise and lower drilling tubulars, such as drill pipe, between a horizontal position near ground level and a vertical position aligned with the drilling axis of the drilling device. Such transfer arms can materially increase the working efficiency of drill rigs in that they simplify and speed the raising of drill pipe from a storage position at or near ground level to a raised position in alignment with the drill string, as well as the removal of pipe from the drill string to the storage position.

In the past, one commercially developed form of such drilling devices used a working platform which was near ground level. In this prior art device, no working platform was positioned in the region between the transfer arm and the drill string in order to allow the transfer arm to approach the drill string closely when in the raised position. With such prior art devices, the absence of a working platform in the region between the transfer arm and the drill string did not create a significant problem, because a worker could simply stand on the transfer arm when in the lowered position in order to walk from one side to the other of the working platform.

Recently, the working platform on some such drilling devices has been raised some distance above the ground in order to allow suitable safety equipment to be placed around the drill string above the ground but below the working platform. In one such device, the working platform is raised ten feet above ground level. In such an arrangement, the absence of a working platform between the drill string and the transfer arm can create serious inconveniences, due to the fact that it is no longer possible simply to walk on the transfer arm in order to move from one side to the other of the working platform. Thus, a need exists for an improved arrangement which provides a working platform in the region between the drill string and the transfer arm, yet which still allows a transfer arm to move to the vertical position, without coming into contact with the platform.

SUMMARY OF THE INVENTION

The present invention is directed to a platform positioning system which operates automatically and mechanically without the need for auxiliary power to raise a working platform as a transfer arm is moved between lowered and raised positions so as to provide a horizontal platform when the transfer arm is in the lowered position, and automatically to move the platform out of the way as the transfer arm is moved to the raised position.

According to this invention, an improvement is provided for a drilling rig of the type having a support structure and a transfer arm pivotably connected to the support structure to rotate about a first axis. According to this invention, a platform is pivotably connected to the support structure to rotate about a second axis and both the transfer arm and the platform are movable between respective raised and lowered positions. The platform is situated such that, when positioned in the lowered position, it obstructs movement of the transfer arm into the raised position. A rod is provided having a lower end mounted to the transfer arm to pivot about an arm axis, and an upper end of the rod is mounted to the platform to pivot about a platform axis. The position of the arm and the platform axes and the length of the rod are selected such that the transfer arm automatically and progressively raises the platform to the raised position by means of the rod as the transfer arm moves to the raised position, and the transfer arm automatically and progressively lowers the platform to the lowered position by means of the rod as the transfer arm moves to the lowered position.

The platform positioning system of this invention provides a number of important advantages. First, it operates automatically to lower the platform when needed and to raise it out of the way of the transfer arm when the transfer arm is raised. Because it operates automatically, the positioning system of this invention provides important safety advantages in that it prevents the platform from remaining in the raised position when the transfer arm is lowered, and thereby substantially prevents a worker from falling through the region covered by the platform when in the lowered position. Furthermore, this invention operates mechanically, and in some preferred embodiments does not require any external power sources. In addition, the preferred embodiments described below start raising the platform at a slow rate, to allow a worker to leave the platform as it rises.

The invention itself, together with further objects and attendant advantages, will best be understood by reference to the following detailed description, taken in conjunction with the accompanying drawings.

BRIEF DESCRIPTION OF THE DRAWINGS

In FIG. 1, a transfer arm of the drilling apparatus is shown in a lowered position.

FIG. 2 is a perspective view of the embodiment of FIG. 1 showing the transfer arm in the lowered position of FIG. 1.

FIG. 3 is an end elevational view taken along line 3—3 of FIG. 1*a*.

FIG. 7 is a perspective view corresponding to that of FIG. 2 of a drilling device which incorporates a second preferred embodiment of this invention.

FIG. 8 is a fragmentary plan view of a portion of the embodiment of FIG. 7.

FIG. 9 is a schematic fragmentary side elevational view of a portion of the embodiment of FIG. 7.

DETAILED DESCRIPTION OF THE PRESENTLY PREFERRED EMBODIMENTS

Figures 1, 1A:
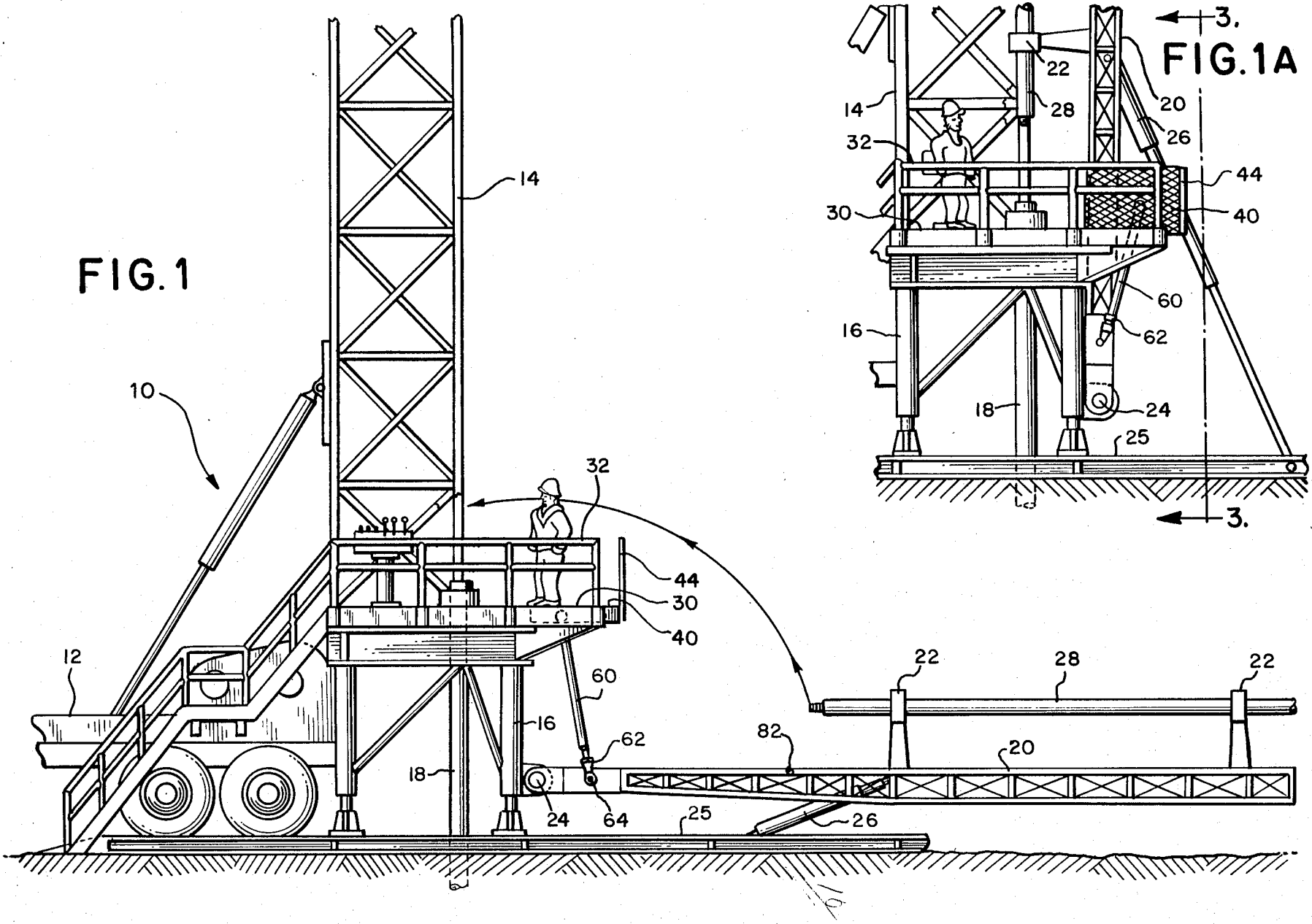
FIG. 1 is a side elevational view of a drilling apparatus which incorporates a first preferred embodiment of this invention.
FIG. 1*a* is a side elevational view corresponding to FIG. 1 in which the transfer arm is shown in a raised position.

Turning now to the drawings, FIG. 1 shows a side elevational view of portions of a drilling apparatus which incorporates a first preferred embodiment of this invention. As shown in FIG. 1, a drill rig 10 of the type which includes a wheeled carrier 12 is provided with a drilling mast 14. A drilling substructure 16 is positioned under the drilling mast 14 to support vertical loads associated with the raising and lowering of a drill string 18.

A transfer arm 20 is pivotably mounted to the substructure 16 about a pivot axis 24. The transfer arm 20 is provided with two pipe clamps 22 which are adapted to clamp and hold a length of a downhole tubular 28 such as drill pipe. The carrier 12 and the substructure 16 are positioned on a drilling ramp 25. This drilling ramp 25 serves to mount a hydraulic cylinder 26 which is coupled to the transfer arm 20. The cylinder 26 can be used to move the transfer arm 20 between a lowered position (as shown in FIG. 1) and a raised position (as shown in FIG. 1*a*).

In the lowered position of FIG. 1, the transfer arm 20 is substantially horizontal near ground level. In this orientation, drilling tubulars 28 can readily be loaded into and removed from the clamps 22. When the transfer arm 20 is in the raised position shown in FIG. 1*a*, a clamped tubular 28 is positioned on the drilling axis, in alignment with the drill string 18. In this orientation, the clamped tubular 28 can be inserted into or removed from the drill string 18.

The substructure 16 defines a work area 30 which in this preferred embodiment is situated about ten feet above ground level. This work area 30 is surrounded by a guard rail 32. In use, a driller will typically work on the work area 30 during a drilling operation to control the transfer arm 20 and various drawworks and hydraulic motors used in the drilling operation.

The portions of the drill rig 10 described above form no part of the present invention. Rather, these portions of the drill rig represent the environment of the present invention. For this reason, these portions will not be described in greater detail here. The following U.S. patents provide additional description of the manner in which the transfer arm 20, the U.S. Pat. Nos. 4,303,270 and 4,366,606, assigned to the assignee of the present invention.

Figures 4, 5, 6:
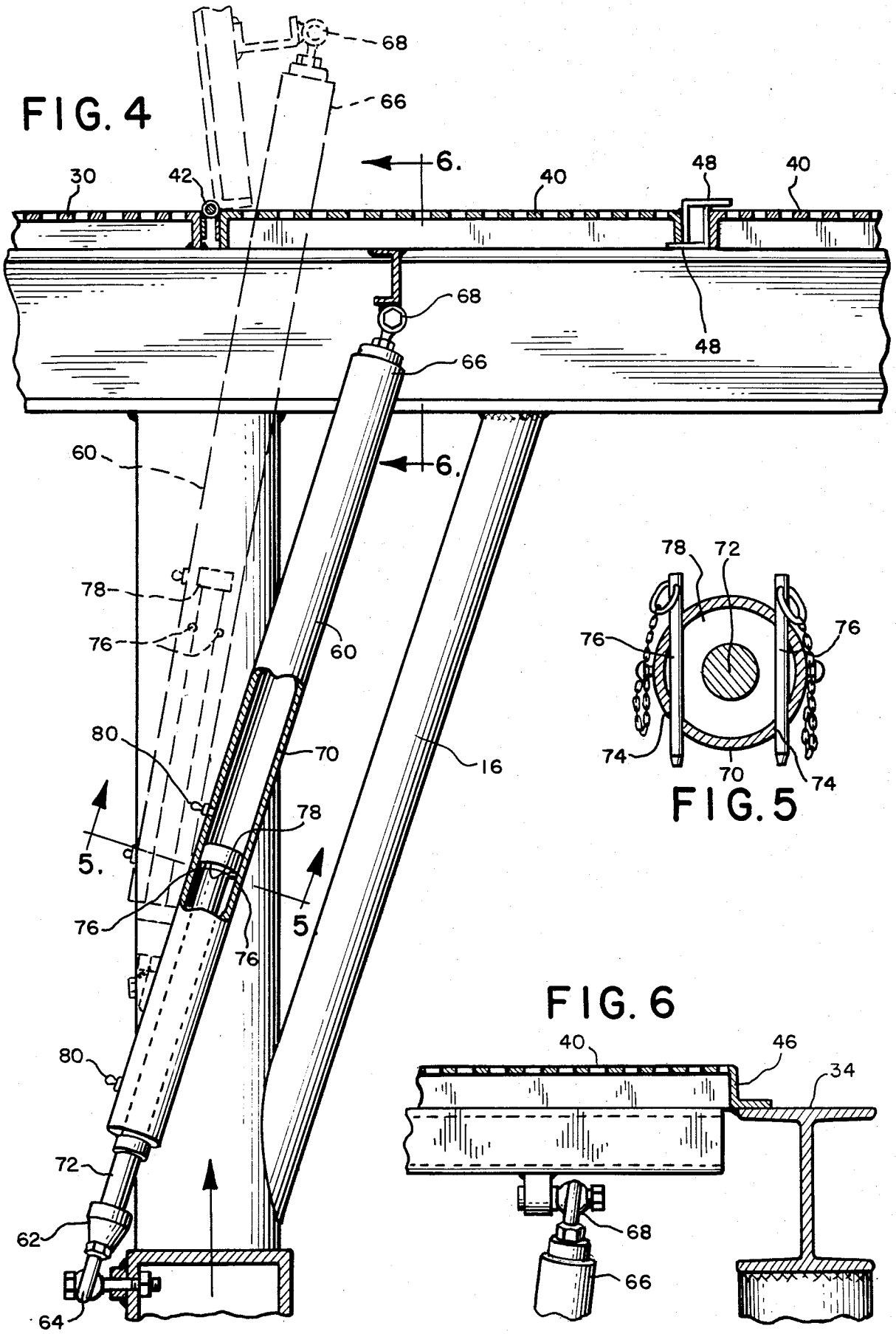
FIG. 4 is an enlarged view of a portion of the embodiment of FIG. 1, in which a rod and platform are shown in solid lines in a lowered position, and in dotted lines in a raised position.
FIG. 5 is a sectional view taken along line 5—5 of FIG. 4.
FIG. 6 is a fragmentary sectional view taken along line 6—6 of FIG. 4.

According to this invention, the drill rig 10 includes two platforms 40 (best shown in FIGS. 2 and 3) which are hinged to the work station 30 by hinges 42. As shown in FIGS. 2 and 3, these hinges 42 are in this preferred embodiment oriented parallel to one another, and the projection of each of the hinges 42 onto the pivot axis 24 is transverse to the pivot axis 24. Thus, the pivot axis 24 as shown in FIG. 3 is in the plane of FIG. 3, and the hinges 42 are perpendicular to the plane of FIG. 3. Each of the platforms 40 serves to mount a respective guard rail 44 which is fixedly mounted to the platform 40 on the side of the platform 40 adjacent the transfer arm 20. In addition, each of the platforms 40 defines a side lip 46 which is positioned to rest on an upper beam 34 of the substructure 16 (as shown in FIG. 6) when the platform 40 is in the lowered position. Furthermore, each of the platforms 40 defines a respective center lip 48 positioned as shown in FIG. 4 to overlap with one another in order to brace the two platforms 40 with respect to one another at their junction.

Each of the platforms 40 pivots about the respective hinge 42 between a lowered position (as shown in FIG. 2) and a raised position (as shown in FIG. 3). When the platforms 40 are in the lowered position of FIG. 2, the guard rails 44 cooperate with the guard rails 32 to enclose the work area 30 and the platforms 40. In the lowered position, the platforms 40 form a bridge extending between the two sides of the work area 30 to allow a driller to move from one side to the other of the work area 30 without descending to ground level.

If the platforms 40 remained in the lowered position of FIG. 2 as the transfer arm 20 moved to the raised position of FIG. 1*a*, the platforms 40 would obstruct the upward movement of the transfer arm 20. This can be clearly seen from FIGS. 1*a* and 3. In order to prevent such an obstruction, the hinges 42 are so positioned that, when the platforms 40 are moved to the raised position of FIG. 3, an opening is created between the two sides of the work area 30 sufficient to allow the transfer arm 20 to move fully to its raised position without contacting either of the platforms 40 or the work area 30. The present invention is directed to a particularly simple, mechanical means for automatically moving the platform 40 between the raised and lowered positions in synchrony with the movement of the transfer arm 20.

In this preferred embodiment, the positioning means includes a rod 60 which is shown in each of the FIGS. 1–6, but is shown in particular detail in FIGS. 4–6. As shown in FIG. 4, this rod 60 includes a lower end 62 which defines a lower ball joint 64, and an upper end 66 which defines an upper ball joint 68. The rod 60 is formed of two telescoping components: a tube 70 which defines the upper end 66 and the majority of the length of the rod 60, and an inner rod 72, which defines the lower end 62 and is sized to fit within the tube 70.

The lower ball joint 64 is secured to the transfer arm 20 such that the lower end 62 of the rod 60 moves with the transfer arm 20 and is driven by the transfer arm 20. The upper ball joint 68 is oriented transversely to the lower ball joint 64, and is mounted to the underside of the respective one of the platforms 40 so as to move with and drive the platform 40.

The tube 70 defines two parallel guide slots 74, as shown in FIG. 5. Each of these guide slots 74 serves to receive a respective locking pin 76. When positioned in the guide slots 74, the locking pins 76 bear on an annular shoulder 78 defined by the inner rod 72. When the locking pins 76 are in place, as shown in FIGS. 4 and 5, the inner rod 72 is free to telescope and slide within the tube 70 so as to vary the separation between the lower and upper ball joints 64,68 by a predetermined amount. In this preferred embodiment, when the locking pins 76 are in place, the length of the rod 60 between the lower and upper ball joints 64,68 is 75 and 13/16ths inches when the rod 60 is in tension, and 72 and 13/16ths inches when the rod 60 is in compression. Thus, when the pins 76 are in place, the telescoping action of the inner rod 72 within the tube 70 allows a variation in the effective length of the rod 60 by 3 inches. When the pins 76 are removed, the inner rod 72 is free to slide to a greater extent within the tube 70, and the maximum length of the rod 60 in tension when the pins 76 are removed from the guides 74 is 93 and 15/16ths inches.

In this preferred embodiment, the lower and upper ball joints 64,68 are rod end bearings such as those manufactured by Spherco and distributed as Part No. CFM-12NY. Such rod end bearings allow pivoting movement of about plus or minus 25°. Two grease fittings 80 are provided to ensure that the movement of the inner rod 72 within the tube 70 is adequately lubricated. A storage attachment point 82 is defined at each side of the transfer arm 20, as shown in FIG. 1. This storage attachment point 82 can be used to secure the upper end of the rod 60 to the transfer arm 20 after it has been removed from the platform 40, for storage.

In operation, this first preferred embodment of the platform positioning system of this invention operates entirely mechanically, and is powered by the motion of the transfer arm 20. As the transfer arm 20 moves upwardly from the position shown in FIG. 2 to that shown in FIG. 3, the rods 60 serve to raise and rotate the platforms 40 about the hinges 42 from the position shown in FIG. 2 to that shown in FIG. 3. Because the cylinder 26 operates at its largest diameter when the transfer arm 20 is near horizontal, the initial movement of the platforms 40 is relatively slow and progressive. This progressive raising of the platforms 40 allows a driller standing on the platforms 40 to move to the work area 30 as the platforms 40 move upwardly. On the downward trip, as the transfer arm 20 moves from the raised position of FIG. 1*a* to the lowered position of FIG. 1, the rods 60 serve automatically to lower the platforms 40 in a smooth, progressive manner.

Thus, the system described above in conjunction with FIGS. 1–6 operates entirely automatically to move the platforms 40 in synchrony with the transfer arm 20. This automatic positioning of the platforms 40 into a lowered position when the transfer arm 20 is near ground level is an important safety feature, for it allows drillers to move from one side to the other side of the work area 30 on a smooth, level surface which is bounded by the guard rails 44. Preferably, the uppermost surface of the platform 40 is formed of an expanded metal to provide good traction.

The positioning system described above is simple, reliable, inexpensive, and safe in operation. When the platforms 40 are in the raised position as shown in FIG. 3, they act as a safety wall or barrier, in order automatically to prevent drillers or other workmen from moving off of the platform 30 into the region occupied by the raised transfer arm 20. This feature of the invention is directly attributable to the fact that the transfer arm and the platform are hinged in planes which are perpendicular to one another.

A further advantage of this embodiment relates to the telescoping action of the rods 60. Because the lowered position of the transfer arm 20 will vary within a predetermined range, depending on the height of the pipe racks used to move tubulars 28 into and out of the clamps 22, the transfer arm 20 does not have a predetermined home position in the lowered position. In contrast, it is important that the platforms 40 consistently lower to a horizontal orientation, regardless of the precise position of the transfer arm 20 when it is near ground level. The preferred embodiment described above in conjunction with FIGS. 1–6 solves this problem by dimensioning the rod 60 such that the platforms 40 reach a fully lowered position when the transfer arm 20 is about 6° above the horizontal. As the transfer arm 20 moves more closely to the horizontal than 6° above the horizontal, the platforms 40 do not move. Rather, the rods 60 elongate as necessary to accommodate further downward travel of the transfer arm 20. In this way, a secure, horizontal orientation is provided for the platforms 40 in the lowered position, whenever the transfer arm 20 is within 6° of the horizontal.

If it is desired to leave the platforms 40 in the raised position shown in FIG. 3 as the transfer arm 20 is moved up and down, the locking pins 76 can be removed. Once the locking pins 76 are removed, the rods 60 are free to telescope sufficiently that the upper ends 66 of the rods 60 remain attached to the raised platforms 40 and the lower ends 62 of the rods 60 remain attached to the transfer arm 20 as it moves between the raised and lowered positions.

Turning now to FIGS. 7–9, a second preferred embodiment of the positioning system of this invention is there illustrated. This second preferred embodiment is utilized in a drill rig which is similar in many respects to that of FIGS. 1–6. In this second preferred embodiment, analogous components of the drill rig have been designated by reference numerals which are exactly one hundred greater than the corresponding reference numerals of FIGS. 1–6. Thus, the transfer arm 120 of FIG. 7 corresponds to the transfer arm 20 of FIGS. 1–6.

As shown in FIGS. 7–9, the second preferred embodiment includes two rods 190 which telescope in a manner similar to that described above, and which are pivotably connected by spherical bearings at their lower ends to the transfer arm 120 and at their upper ends to respective ones of the two platforms 192. Each of these platforms 192 is mounted by a respective hinge 194 to the substructure 116. In this case, however, the hinges 194 are oriented so as to be coplanar with the pivot axis 124 of the transfer arm 120. The orientation of the hinges 194 is clearly shown in FIGS. 7 and 8. Each of the platforms 192 defines a lip 196 at its outside edge adjacent the work area 130. When the platforms 192 are in the lowered position shown in FIGS. 7 and 8, the lips 196 support the weight of the platforms 192 and prevent them from moving below a horizontal position.

A guard rail 198 is pivotably mounted at a respective rail pivot 200 secured to the substructure 116 adjacent to each of the two platforms 192. A pivot arm 202 is rigidly secured to each of the guard rails 198 below the level of the work area 130. Each of these pivot arms 202 is connected to a respective cylinder 204, such as an air cylinder which is pivotably connected to the substructure 116.

In this preferred embodiment, both of the air cylinders 204 are powered by compressed air which is valved by an automatically operated valve 206 mounted on the transfer arm 120. This automatic valve 206 is driven by a weight 208 and acts to control the cylinders 204 in accordance with the tilt angle of the transfer arm 120. When the transfer arm 120 moves from a horizontal position to an angular orientation of about 25° above the horizontal, the weight 208 moves the valve 206 so as to cause the cylinders 204 to pivot the rails 198 inwardly, toward the direction shown in dotted lines in FIG. 7. At first, this inward motion of the guard rails 198 is relatively slow so as to give drillers time to move off of the platforms 192 as the guard rails 198 move inwardly. As the transfer arm 120 moves upwardly further, the rods 190 serve to pivot the platforms 192 about the hinges 194 so as to prevent the platforms 192 from coming into contact with the transfer arm 120.

As the transfer arm 120 moves downwardly from the raised to the lowered positions, the rods 190 serve automatically to lower the platforms 192. When the tilt angle of the transfer arm 120 reaches 20° with respect to the horizontal, the weight 208 shifts the valve 206 in order to cause the gates automatically to move from the position shown in dotted lines in FIG. 7 to the position shown in solid lines in FIG. 7. In this way, the guard rails 198 cooperate with the guard rails 132 to surround the perimeter of the work area 130 and the platforms 192 when the platforms 192 are in the lowered position. As before, a storage attachment point 210 is provided on each side of the transfer arm 120 in order to fasten the upper end of the respective rod 190 for storage.

From the foregoing, it should be apparent that the platform positioning systems described above operate automatically to move the platforms out of the way of the transfer arm as the transfer arm moves upwardly, and to return the platforms to the lowered, horizontal position as the transfer arm moves back down. In this way, safety of operation is enhanced with a particularly simple and reliable system. The telescopic feature of the rods allows the platforms to return to a horizontal position regardless of the precise tilt angle of the transfer arm in its lowered position.

Of course, it should be understood that a wide range of changes and modifications to the preferred embodiments described above will be apparent to those skilled in the art. The platform positioning system of this invention can be adapted for use with a wide range of drilling devices which employ transfer arms, and it should be understood that this invention is not limited to the precise drilling structures shown above. Furthermore, a wide variety of mechanical structures can be used to form the rods 190 to provide the desired telescoping action. It is therefore intended that the foregoing detailed description be regarded as illustrative rather than limiting, and that it be understood that it is the following claims, including all equivalents, which are intended to define the scope of this invention.

I claim:

1. In combination with a drilling apparatus of the type having a support structure and a transfer arm pivotably connected to the support structure to rotate about a first axis, the improvement comprising:

a platform pivotably connected to the support structure to rotate about a second axis, said transfer arm and platform movable between respective raised and lowered positions, said platform when positioned in the lowered position situated to obstruct movement of the transfer arm into the raised position;

a rod having an upper end and a lower end;

means for mounting the lower end of the rod to the transfer arm to pivot about an arm axis; and means for mounting the upper end of the rod to the platform to pivot about a platform axis;

the position of the arm and platform axes and the length of the rod selected such that the transfer arm automatically and progressively raises the platform to the raised position by means of the rod as the transfer arm moves to the raised position, and the transfer arm automatically and progressively lowers the platform to the lowered position by means of the rod as the transfer arm moves to the lowered position.

2. The invention of claim 1 wherein the rod comprises means for extending the effective length of the rod when the rod is placed in tension as compared with when the rod is placed in compression.

3. The invention of claim 2 wherein the extending means comprises:

first and second rod sections; and means for mounting the first and second rod sections together to allow limited longitudinal movement therebetween.

4. The invention of claim 1 wherein the first and second axes are positioned in first and second planes, respectively, and the first plane is substantially perpendicular to the second plane.

5. The invention of claim 4 wherein the means for mounting the lower and upper ends of the rod comprise respective spherical rod end bearings, each of which allows a predetermined degree of rotation of the rod about an axis perpendicular to the respective one of the arm and platform axes.

6. The invention of claim 1 wherein the first axis is substantially parallel to the second axis, wherein the platform is positioned alongside an adjacent structure, and wherein a pivotable gate is positioned on the adjacent structure.

7. In combination with a drilling apparatus of the type having a support structure and a transfer arm pivotably connected to the support structure to rotate about a first axis, the improvement comprising:

a platform pivotably connected to the support structure to rotate about a second axis, said transfer arm and platform movable between respective raised and lowered positions, said platform when positioned in the lowered position situated to obstruct movement of the transfer arm into the raised position;

a telescoping rod comprising first and second rod sections and means for securing the first and second rod sections together to provide axial movement therebetween for a first distance;

means for mounting the first rod section to the platform such that the first rod section pivots about a platform axis and is movable through a first angular range in a plane passing through the platform axis; and means for mounting the second rod section to the transfer arm such that the second rod section pivots about an arm axis and is movable through a second angular range in a plane passing through the arm axis;

the position of the arm and platform axes and the length of the telescoping rod selected such that the transfer arm automatically and progressively raises the platform to the raised position by means of the rod as the transfer arm moves to the raised position, and the transfer arm automatically and progressively lowers the platform to the lowered position by means of the rod as the transfer arm moves to the lowered position;

the length of the rod and the first distance chosen such that movement of the transfer arm within a predetermined range of positions adjacent the lowered position produces no movement of the platform from the lowered position.

8. In combination with a drilling apparatus of the type having a support structure and a transfer arm pivotably connected to the support structure to rotate about a first axis, the improvement comprising:

a platform pivotably connected to the support structure to rotate about a second axis, situated in a first plane perpendicular to a second plane which includes the first axis, said transfer arm and platform pivotable about the respective axes between respective raised and lowered positions, said platform when positioned in the lowered position situated to obstruct movement of the transfer arm into the raised position;

a telescoping rod comprising first and second rod sections and means for securing the first and second rod sections together to provide axial movement therebetween for a first distance;

means for mounting the first rod section to the platform such that the first rod section pivots about a platform axis and is movable through a first angular range in a plane passing through the platform axis; and means for mounting the second rod section to the transfer arm such that the second rod section pivots about an arm axis and is movable through a second angular range in a plane passing through the arm axis;

the position of the arm and platform axes and the length of the telescoping rod selected such that the transfer arm automatically and progressively raises the platform to the raised position by means of the rod as the transfer arm moves to the raised position, and the transfer arm automatically and progressively lowers the platform to the lowered position by means of the rod as the transfer arm moves to the lowered position;

the length of the rod and the first distance chosen such that movement of the transfer arm within a predetermined range of positions adjacent the lowered position produces no movement of the platform from the lowered position.

9. In combination with a drilling apparatus of the type having a support structure and a transfer arm pivotably connected to the support structure to rotate about a first axis, the improvement comprising:

a platform pivotably connected to the support structure to rotate about a second axis, parallel to the first axis, said transfer arm and platform pivotable about the respective axes between respective raised and lowered positions, said platform when positioned in the lowered position situated to obstruct movement of the transfer arm into the raised position;

a telescoping rod comprising first and second rod sections and means for securing the first and second rod sections together to provide axial movement therebetween for a first distance;

means for mounting the first rod section to the platform such that the first rod section pivots about a platform axis and is movable through a first angular range in a plane passing through the platform axis; and means for mounting the second rod section to the transfer arm such that the second rod section pivots about an arm axis and is movable through a second angular range in a plane passing through the arm axis;

a guard rail pivotably mounted to the support structure adjacent the platform;

the position of the arm and platform axes and the length of the telescoping rod selected such that the transfer arm automatically and progressively raises the platform to the raised position by means of the rod as the transfer arm moves to the raised position, and the transfer arm automatically and progressively lowers the platform to the lowered position by means of the rod as the transfer arm moves to the lowered position;

the length of the rod and the first distance chosen such that movement of the transfer arm within a predetermined range of positions adjacent the lowered position produces no movement of the platform from the lowered position; and means for automatically pivoting the guard rail to a first position along the edge of the platform adjacent the transfer arm when the platform is in the lowered position and for automatically pivoting the guard rail out of the path of the platform as the platform moves to the raised position.

10. The invention of claim 9 wherein the pivoting means comprises:

a cylinder mounted to pivot the guard rail; and an automatic valve for controlling the flow of a pressurized fluid to the cylinder in response to the angular position of the transfer arm.

* * * * *

UNITED STATES PATENT AND TRADEMARK OFFICE

CERTIFICATE OF CORRECTION

PATENT NO. : 4,492,501

DATED : January 8, 1985

INVENTOR(S) : Keith M. Haney

It is certified that error appears in the above-identified patent and that said Letters Patent is hereby corrected as shown below:

IN THE DETAILED DESCRIPTION OF THE PRESENTLY PREFERRED EMBODIMENTS

In column 3, line 41, please delete "the U.S." and substitute therefor --the clamps 22, and the drill rig 10 can be constructed: U.S.--.

Signed and Sealed this

Twenty-second Day of March, 1988

*Attest:*

*Attesting Officer*

DONALD J. QUIGG

*Commissioner of Patents and Trademarks*